US009618303B2

(12) United States Patent
Hensler

(10) Patent No.: US 9,618,303 B2
(45) Date of Patent: Apr. 11, 2017

(54) ELECTRO CONTROL HAZING DEVICE (ECHD)

(71) Applicant: Conceived Innovations, Coeur D'Alene, ID (US)

(72) Inventor: Scott E. Hensler, Coeur D'Alene, ID (US)

(73) Assignee: Conceived Innovations, Coeur D'Alene, ID (US)

( * ) Notice: Subject to any disclaimer, the term of this patent is extended or adjusted under 35 U.S.C. 154(b) by 21 days.

(21) Appl. No.: 14/868,349

(22) Filed: Sep. 28, 2015

(65) Prior Publication Data

US 2016/0091284 A1 Mar. 31, 2016

Related U.S. Application Data

(60) Provisional application No. 62/057,212, filed on Sep. 29, 2014.

(51) Int. Cl.
*F41H 13/00* (2006.01)

(52) U.S. Cl.
CPC ..... *F41H 13/0031* (2013.01)

(58) Field of Classification Search
CPC ..... F41H 13/0031; F41H 13/0012; F41H 13/0018; F41H 13/0025; F41H 13/0037; A01K 15/021; A01K 15/022; A01K 15/023
USPC ..... 102/430
See application file for complete search history.

(56) References Cited

U.S. PATENT DOCUMENTS 2,805,067 A * 9/1957 Ryan ..... F41B 13/10 200/61.49
3,626,626 A * 12/1971 Blanc ..... F41H 13/0031 231/7
3,777,712 A * 12/1973 Gardner ..... A01K 15/021 119/719
4,745,882 A * 5/1988 Yarnall, Sr. ..... A01K 3/00 119/721
5,207,179 A * 5/1993 Arthur ..... A01K 15/023 119/721
5,473,501 A * 12/1995 Claypool ..... F41H 13/0031 102/201
5,640,932 A * 6/1997 Bianco ..... A01K 15/023 119/720
5,698,815 A * 12/1997 Ragner ..... F41H 13/0006 102/293

(Continued)

*Primary Examiner* — Joshua Freeman
(74) *Attorney, Agent, or Firm* — John Chandler

(57) ABSTRACT

An electronic conditioning device delivers electric shocks correlated with sounds or driven by a signal associated with a sound sequence. The sound sequence can be a few seconds of a recorded human voice, a siren, a single tone, and so forth. A sound generator emits the sound sequence audibly. A power supply is electrically connected to the various components and provides energy to a shock inducer or electrodes embedded in the skin of a target. The device administers voltage spikes and sounds in a coordinated fashion. The conditioning encourages the target to associate certain sounds with the electric shock. Power may be supplied by a battery, a piezoelectric flexible film or movable magnet that converts kinetic motion into electric energy. Preferably, the device is applied to a target by loading the device into a shotgun shell and firing the loaded shell at the target from a rifle, pistol or shotgun.

19 Claims, 8 Drawing Sheets

(56) References Cited

U.S. PATENT DOCUMENTS

| | | | | |
|---|---|---|---|---|
| 6,615,770 | B2 * | 9/2003 | Patterson | A01K 15/021 119/719 |
| 6,825,768 | B2 * | 11/2004 | Stapelfeld | A01K 15/021 119/421 |
| 7,421,979 | B2 * | 9/2008 | Kim | A01K 15/023 119/712 |
| 7,770,541 | B2 * | 8/2010 | Boyd | A01K 15/021 119/719 |
| 7,984,676 | B1 * | 7/2011 | Gavin | F42B 5/073 102/502 |
| 8,701,325 | B1 * | 4/2014 | Rayner | F41H 13/00 42/1.08 |
| 9,295,230 | B1 * | 3/2016 | Beck | A01K 15/023 |
| 2004/0206310 | A1 * | 10/2004 | Hutchins | A01K 15/021 119/720 |
| 2005/0073796 | A1 * | 4/2005 | Smith | F41H 13/0031 361/232 |
| 2005/0188887 | A1 * | 9/2005 | Chang | F41C 9/00 102/502 |
| 2006/0162605 | A1 * | 7/2006 | Genis | F41H 13/0031 102/512 |
| 2006/0279898 | A1 * | 12/2006 | Smith | H05C 1/04 361/232 |
| 2010/0101445 | A1 * | 4/2010 | Garg | F41A 9/65 102/502 |
| 2012/0247397 | A1 * | 10/2012 | Lvovskiy | A01K 15/021 119/720 |

* cited by examiner

ELECTRO CONTROL HAZING DEVICE (ECHD)

This application claims the benefit and filing date of U.S. provisional patent application filed on 29 Sep. 2014 and having Ser. No. 62/057,212.

BACKGROUND

Field

The present invention relates generally to devices to deliver electro control energy via a projectile or dart fired from a gun. Particularly, influence is gained over an animal or human without substantial neurological distress of the same through combination of sound correlated with electric shock delivered via a dart or projectile to a target.

Related Art

It is known to apply electric shock for conditioning and corralling animals such as livestock. It is also known to fire projectiles or electric leads into a target and to apply electric energy to the target.

Above-ground electric fences take a variety of forms. Electrical fences are typically energized with a low level electrical pulse. One limitation of these fences is that a conditioned target is only conditioned as to identity of the electric fence and its location. Other animal control systems implement buried wires, commonly known as invisible fences. These invisible fences include a transmitter which generates a coded signal that is radiated by a wire loop antenna buried a few inches underground and which defines an area for containing or restricting the animal. Electrical fence systems involve costly installation of a physical structure and require maintenance.

Use of electrified projectiles requires substantial attention to monitor the physical condition of livestock, animal or human as the target so as not to abuse the target. The application of electricity is not correlated or associatable with anything other than the presence of instigator of the electric shocks. Further, electric shock is only applied for a short time and is not uniformly accompanied by any other conditioning or treatment.

Accordingly, the present disclosure is directed toward overcoming many of the above-identified shortcomings of known techniques.

SUMMARY

Embodiments and techniques described herein relate to an electronic conditioning device that comprises sound sequence circuitry that generates a sound sequence such as a recorded human voice. The sound sequence includes sounds, each sound having one of various levels of intensity. A sound generator emits the sound sequence audibly. A power supply is electrically connected to the sound sequence circuitry and sound generator and provides energy to a shock inducer. The shock inducer has one or more electrodes which are designed to impact and stick to or embed under the skin of a target. The shock inducer is configured to generate voltage spikes in coordination with and approximately at a same time as at least some of the sounds of the sound sequence so as to condition the target. The conditioning allows the target to associate certain sounds (e.g., a word, phrase, siren, tone) with an electric shock. The electric shock may include voltage spikes that are correlated with the pitch, intensity, presence or other aspect of the sounds of the sound sequence. Power may be supplied by a battery, or a piezoelectric flexible film or movable magnet that converts kinetic motion into electric energy. Preferably, the device is applied to a target by loading the device into a shotgun shell and firing the loaded shell at the target from a rifle, pistol or shotgun.

This summary is provided to introduce a selection of concepts in a simplified form that are further described below in the detailed description. This summary is not intended to identify key or essential features of the claimed subject matter, and thus is not intended to be used to limit the scope of the claimed subject matter.

BRIEF DESCRIPTION OF THE DRAWINGS

While the appended claims set forth the features of the disclosure with particularity, the disclosure, together with its objects and advantages, is more readily appreciated from the following detailed description, taken in conjunction with the accompanying drawings. Throughout, like numerals generally refer to like parts. Unless specifically indicated, the components and drawings are not shown to scale.

FIG. 8A is before impact with a target and FIG. 8B is after impact with the target.

GLOSSARY

Figure 1:
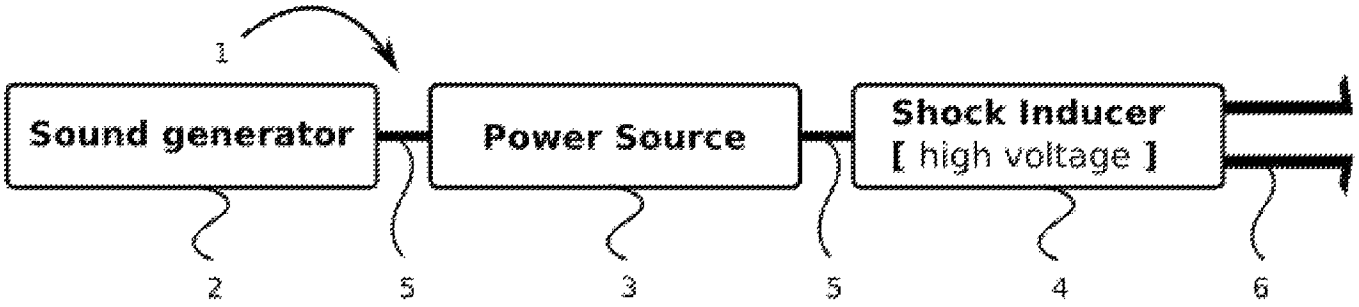
FIG. 1 illustrates a schematic overview of components of a device for delivering a shock and an audible signal to a target.

1 device
2 sound generator
3 power source
4 shock inducer
5 electrical connection
6 electrode
10 shotgun shell
12 housing
13 sound generator
14 circuitry
15 weight
16 low voltage electric coils

17 high-power electric coils
18 earth magnet
19 flexible reed
19A foot
20 sidewall
21 metal endplate
22 metal sidewall
23 primer
24 enclosed space
25 distal end
26 proximal end
27 distal end
28 nozzle
29 dye packet
30 endplate
30A apertures
31 piezoelectric film
32 base
33 motion arrow
34 length
35 diameter
36 collection of components
40 voltage graph
41 vertical axis
42 baseline voltage
43 maximum voltage
44 voltage
45-47 voltage spikes
50 sound sequence
51 enunciated words
52 pauses or recorded silence
53 speaker
54 electronic components
55 fastener
56 bladder of electrolyte
57 first electrode
58 barb
59 second electrode
60 procedure
61-64 steps of procedure

DETAILED DESCRIPTION

Overview. The present disclosure solves many of the shortcomings of known devices and methods of administering electrical signals or electric shock to a target and conditioning the target to react to one or more predetermined or designated audible signals, sounds, speech and so forth. The device is projected at a target. Electrodes engage the skin and facilitate electrical shocks to the target via a power source. The device coordinates the electrical shocks with audible tones such that the target associates the audible tones with the sensation and stimulation of the electrical shocks. The following disclosure provides further details.

FIG. 1 illustrates a schematic overview of components of a device 1 for delivering a shock and an audible signal to a target. With reference to FIG. 1, a sound generator 2 is electronically connected via a lead 5 to a power source or power supply 3. The power source 3 is also electronically connected via another lead 5 to a shock inducer 4. The shock inducer 4 preferably uses a high voltage to deliver electric current to a target (not shown) via one or more electrodes 6. Preferably, the sound generator 2 is activated in coordination with activation of the shock inducer 4. Several variations of power source 2 are possible. Each such power source determines which components are required for operation of the device 1. Various embodiments of the device are described below.

Figure 2:
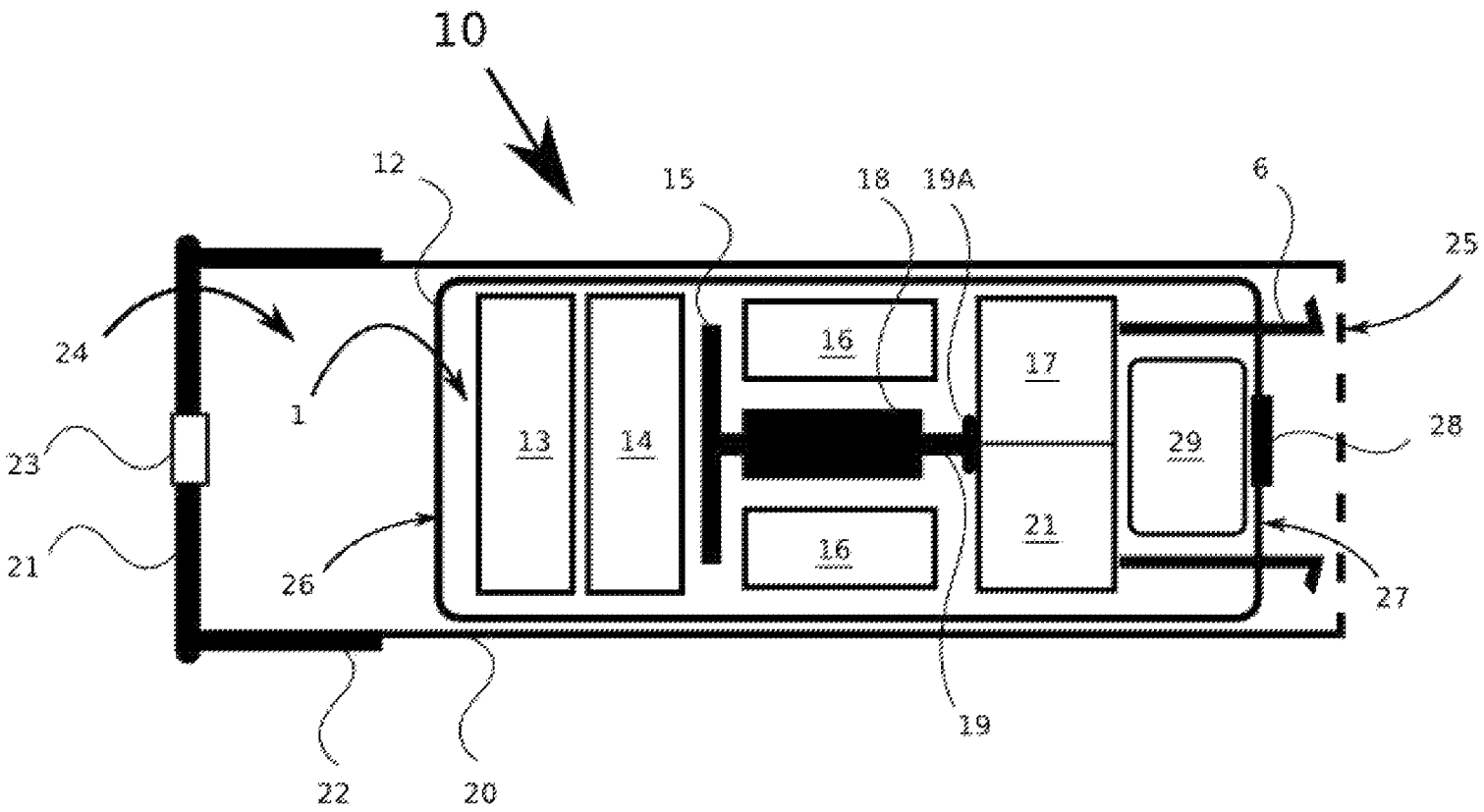
FIG. 2 illustrates a cross sectional side view of a first embodiment of a device first shown in FIG. 1 where the power source includes use and motion of a magnet to generate power for the device.

FIG. 2 illustrates a cross sectional view of a first embodiment of a device first shown in FIG. 1 where the power source includes use and motion of a magnet to generate power for operating at least some of the components of the device. With reference to FIG. 2, a device 1 is placed inside a shotgun shell 10. The shotgun shell 10 includes a generally metal endplate 21, a metal sidewall 22 and a sidewall 20 which may be made from a plastic, metal, polymer, glass or other material. The distal end 25 of the shell 10 may be enclosed with wrappings of the sidewall 20 or may be open depending on the needs or configuration of the device 1. The end plate 21 is loaded with a primer 23 that may serve as propellant. Additionally, The endplate 21, metal sidewall 22 and sidewall 20 enclose a space 24 that may house a propellant (not shown) such as a combustible material such as gunpowder or the like for projecting the device 1 from the distal end 25 of the shell 10.

The device 1 includes a housing 12 having a proximal end 26 and a distal end 27. The housing 12 encloses other components of the device 1. The device 1 includes a sound generator 13 which in turn includes a piezoelectric speaker. The sound generator 13 is powered by a power source. The sound generator 13 is recordable for approximately 6-15 seconds. The sound may be an animal, human or siren-type noise. The message repeats as long as power is available. The sound generator 13 is electronically connected with circuitry 14 and a power source which includes various components in the device 1. The circuitry 14 may include controlling elements that direct actuation of the other elements in the device 1 such as the sound generator 13 or electrodes 4 for delivering conditioning shocks. According to a variation, the circuitry 14 includes an element for recording and storing the sounds that are then passed to the sound generator 13.

At least part of the power source includes an earth magnet 18 affixed to a flexible reed 19 that is held at a distal end by a foot 19A. Affixed to the proximal end of the reed 19 is a counter weight 15 that facilitates bending and motion of the reed 19 and magnet 18 within or proximate to low voltage electric coils 16. The reed 19 oscillates back and forth by inertia during initial impact and movement of the target after receiving the device 1. Electromotive force (EMF) is generated thereby. The power source may also include high-voltage electric coils 17 and one or more high-voltage capacitors 21. The reed 19 and coils 16 may provide power to the high-voltage electric coils 17 and high-voltage capacitors 21. The power source provides electrical energy to the sound generator 13, the electrodes 4 and circuitry 14. In the figures shown herein, not all electrical leads and connections are shown for the sake of simplicity of illustration only so as to not obscure the operation and structures of the disclosure.

Referring again to FIG. 2, once the device 1 or dart is deployed, movement of the target (i.e., animal, human), as the electrical charge or shock is generated, the shock will cause discomfort to the target. The target is likely induced to move and move rapidly. Further movement causes further motion of the reed 19 and magnet 18. Further energy is further generated which in turn causes the device 1 to further shock the target. The more the target moves, the longer the generation of the shock power to haze the target.

Sound is released by the dart or device 1 by the sound generator 13 at impact. According to one implementation, the sound may be similar to or a recording of a human voice yelling at 85 dB. The sound is provided contemporaneously with the electrical shock. This method is for compliant behavior modification and recognition of the human voice or the sound of the recording in the device. This method (application of the device 1) trains the target to avoid human contact so as to associate pain with a human voice. The high voltage of the shock provided through the electrodes 4 may be modulated along with the intensity of the voice sound emitted from the device 1. As the words are emitted from the sound generator 13, the voltage or amount of shock felt by the target is modified or changed to match that of the enunciation of the words. The highs and lows of the speech match the shock and absence of shock, respectively. This method is referred to as psychotronic technology. More description of this technology is provided herein in relation to other figures, especially FIG. 7.

Referring again to FIG. 2, at the tip of the device 1, preferably inside the outer edge of the shell or cartridge 10 is a dye package or packet 29 that includes a dye or a marking ink that releases on impact with the target to later identify the target as receiving hazing, shock and treatment by the device 1. The dye is preferably released through a nozzle 28 such that the momentum and kinetic energy of the device 1 when fired at the target causes excretion of the dye onto the target when the target's body stops the moving projectile.

The device 1 also includes electrodes 13 that extend outward from the distal end 27 of the housing 12 and yet still within the cartridge 10. The electrodes 13 are designed to embed in the skin of the target and persist the projectile on the target for at least a designated time. The size, shape and number of electrodes may be varied to accomplish this end. That is, the shape, composition, length and other aspects of the electrodes 13 are selected based on an amount of time that the device 1 is designed to work. Such characteristics may be selected based on type of animal or situation for which the device 1 is intended to be used. That is, various models of the device 1 may be manufactured depending on the intended use without departing from the teachings of this disclosure. Preferably, the housing 12 (projectile) fits inside a 12-gage shotgun shell 10 so that the device 1 works with conventional shotguns and other known or established projecting means.

Figure 3:
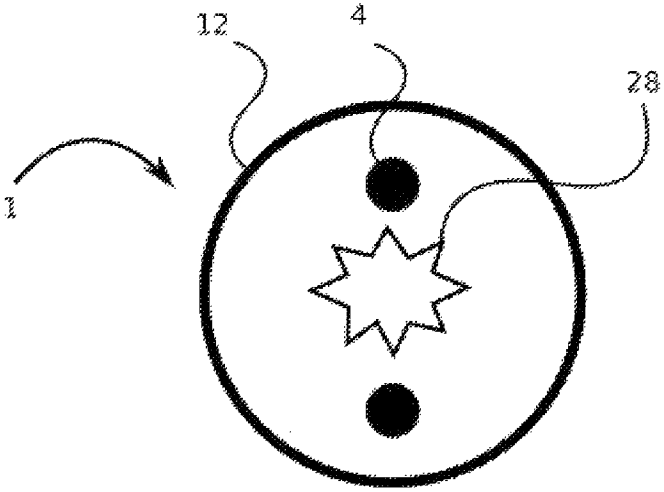
FIG. 3 illustrates an end view of the distal end of the embodiment of the device shown in FIG. 2.

FIG. 3 illustrates an end view of the distal end of the embodiment of the device 1 shown in FIG. 2 without the shotgun shell 10. With reference to FIG. 3, a pair of electrodes 4 project upwardly away from the housing 12 of the device 1. The electrodes 4 are designed to impact, pierce and persist to the skin of the target. A dye or marking ink is extruded from inside the housing 12 through the nozzle 28. The dye (not illustrated) is designed to mark the target for subsequent identification as needed. The dye is preferably made of non-toxic materials and preferably lasts as long as possible. There are several advantages of such dye. For example, a persistent dye facilitates accurate tracking of the behavior and location of the target. Use of non-toxic materials is useful in the event that the target ingests the dye and when the dye is removed and discarded from the target—likely in a natural setting.

A multi-pointed star-shaped nozzle 28 is illustrated in FIG. 3. The nozzle 28 may be round or may be shaped so as to leave a pattern on a target after impact. The shape of the nozzle 28 may be matched to a color or other attribute of the dye or particular use or attribute of the device 1. For example, a five-pointed star silhouette or star-shaped nozzle 28 may be correlated to a first application of the device 1 to a target, and a circular or rectangular silhouette may be correlated to a second application of the device 1 to the same or different target. As another example, a five-pointed star silhouette or star-shaped nozzle 28 may be correlated to an application of the device 1 to a target where the device 1 is sized for a 12-gage shotgun, and a circular nozzle 28 may be correlated to a device 1 that is sized for a 20-gage shotgun. As yet another example, a five-pointed star silhouette or star-shaped nozzle 28 may be correlated to use of the device 1 to a target on a first day or first time, and a circular nozzle 28 may be correlated to use of the device 1 to a same or different target on a second day or second time. Instead of the shape of the nozzle 28, a color of the dye may be varied with the same effect.

In this way, the shape of the ink or dye, or the color of the dye, on the target may be correlated or mapped to a particular time, date or other datum of use (or attribute) of the device 1 on the particular target. This bit of information may be especially useful when the device 1 has fallen off of the target and information about application and use of the device 1 is observed at a later time when an observer encounters a treated target. According to another variation, the shape of the nozzle 28 may be correlated to color or other attribute of the device 1 or dye.

Identification and tracking of use of the device 1 is done by a human observer who can recognize the dye. Various colors or types of dyes may be applied to a target based on previous encounters so that progressive application of the device 1 and prolonged conditioning may be tracked. That is, the device 1 may be loaded with one of several different colors, types or kinds of dyes so that a user may select an appropriate dye for use with a particular type or identity of target.

Figure 4:
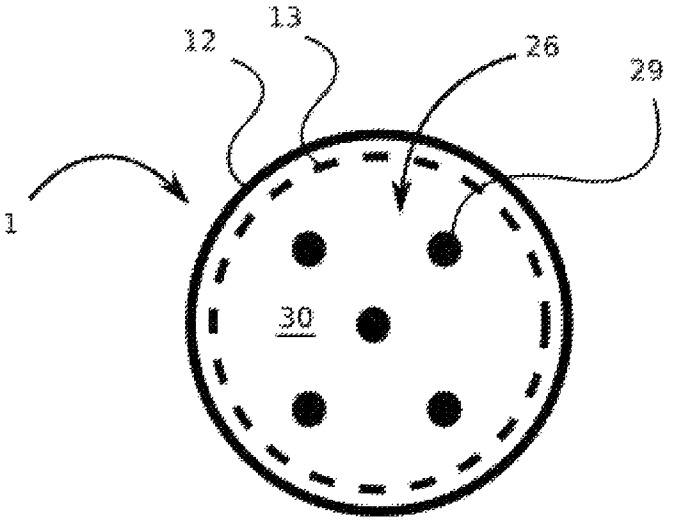
FIG. 4 illustrates an end view of the proximal end of the embodiment of the device shown in FIG. 2.

FIG. 4 illustrates an end view of the proximal end 26 of the embodiment of the device shown in FIG. 2. With reference to FIG. 4, one or more apertures 30A are formed in the end surface or endplate 30 of the device 1. Sound is able to escape through these apertures 30A. The endplate 30 may be formed as part of the housing 12, or from the same or different material of the housing 12 and the endplate 30 is separately fitted or assembled to the tubular housing 12. If the later, the other components of the device 1 may be loaded into the device 1 prior to assembling the endplate 30 to the device 1 and tubular housing 12. An outline of the underlying sound generator 13 is visible inside the endplate 30. According to a variation, the sound generator 13, or circuitry 14, or sound generator 13 and circuitry 14, may be affixed to the endplate 30 during assembly of the completed device 1.

Figure 5:
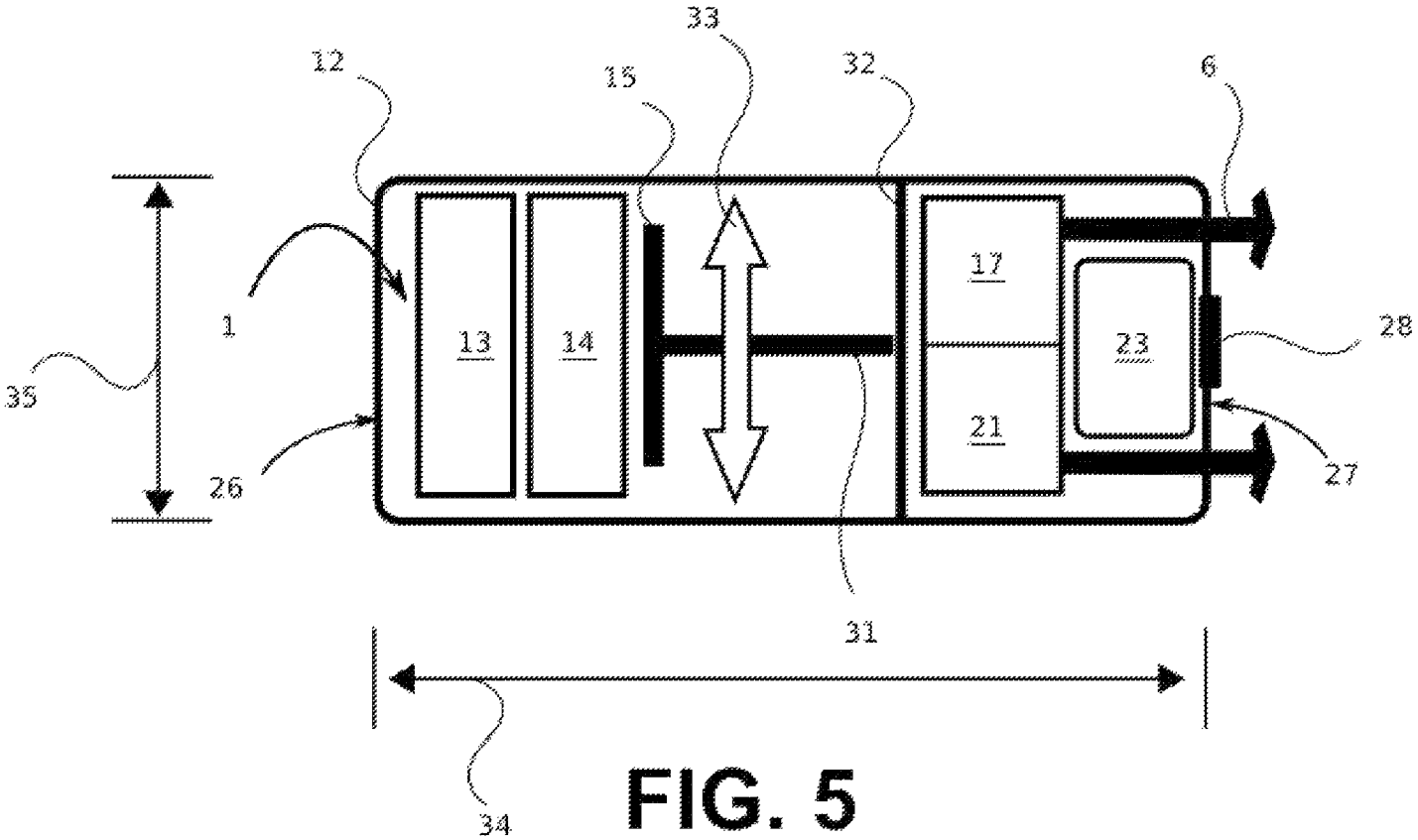
FIG. 5 illustrates a cross sectional side view of a second embodiment of a device first shown in FIG. 1 where the power source includes use and motion of a piezoelectric film.

FIG. 5 illustrates a cross sectional side view of a second embodiment of a device first shown in FIG. 1 where the power source includes use and motion of a piezoelectric film. With reference to FIG. 5, the device 1 includes a housing 12 having a proximal end 26 and a distal end 27. The housing 12 encloses other components of the device 1. The device 1 includes a sound generator 13 which in turn includes a speaker. The sound generator 13 is powered by a power source. The sound generator 13 is recordable for approximately 6-15 seconds. The sound may be an animal, human or siren-type noise. The message repeats as long as power is available. The sound generator 13 is electronically connected with circuitry 14 and a power source which includes various components in the device 1. The circuitry 14 may include controlling elements that direct actuation of the other elements in the device 1 such as the sound generator 13 or electrodes 4 for delivering conditioning shocks. According to a variation, the circuitry 14 includes one or more non-illustrated elements for recording and storing the sounds that are then passed to the sound generator 13.

At least part of the power source includes a piezoelectric film 31 affixed to a base 32. The base 32 may be long enough to reach the sides of the housing 12 so as to provide a substantial, fixed surface or base from which the proximal end of the film 31 may vibrate. A weight 15 may be attached or formed to the proximal end of the piezoelectric film 31 to facilitate more substantial movement of the piezoelectric film 31, and to thereby increase power generation for prolonged conditioning for each application of a device 1 to a target. The film 31 oscillates back and forth by inertia during initial impact and movement of the target after receiving the device 1. Electromotive force (EMF) is generated by the deceleration of impact and movement of the target.

The power source may also include high-voltage electric coils 17 and one or more high-voltage capacitors 21. The piezoelectric film 31 may provide power to the high-power or high-voltage electric coils 17 and high-voltage capacitors 21. The piezoelectric film 31 may be formed from a non-hard ceramic material and is considered a cantilevered electric generator for power harvesting. The power source provides electrical energy to the sound generator 13, the electrodes 4 and circuitry 14. The power source include one or more batteries or capacitors (not shown) that supplement the power provided by the piezoelectric film 31. The motion of the piezoelectric film 31 is shown by a motion arrow 33. The sound generator 13 is recordable for approximately 6-15 seconds and, when activated, repeats the message for as long as power is available.

The length 34 of the device 1 is preferably about two inches, and the diameter 35 is approximately 0.690 inches. The diameter 35 may be selected based on a gun shell size such as for a 12-gage shotgun. The diameter 35 is preferably uniform as measured anywhere along its length 34 from a proximal end 26 to a distal end 27. Grooves or fins (not shown) may be formed around or along the outer surface of the housing 12 so as to facilitate a rotation or spiraling of the device 1 when the device 1 is projected from a gun. At least the housing 12 is constructed from an impact resistant or high-impact plastic. Preferably, the device 1 weighs approximately 20 grams or less when fully assembled at no more than 300 feet per second (fps) with a targeted speed of 260 fps. A target range for the projectile is 100 feet before substantial projectile path degradation is observed.

Referring again to FIG. 5, at the distal end 27 or tip of the device 1 is a dye package or packet 29 that includes a dye or a marking ink that releases on impact with the target to later identify the target as receiving hazing, shock and treatment by the device 1. The dye is preferably released through a nozzle 28 such that the momentum and kinetic energy of the device 1 when fired at the target causes excretion of the dye onto the target when the target's body stops the moving projectile.

The device 1 also includes electrodes 13 that extend outward from the distal end 27 of the housing 12 and yet still within the cartridge 10. The electrodes 13 are designed to embed in the skin of the target and persist the projectile on the target for at least a designated time. The shape, composition, length and other aspects of the electrodes 13 are selected based on an amount of time that the device 1 is designed to work. Such characteristics may be selected based on type of animal or situation for which the device 1 is intended to be used. That is, various models of the device 1 may be manufactured depending on the intended use without departing from the teachings of this disclosure. Preferably, the housing 12 (projectile) fits inside a 12-gage shotgun shell 10 so that the device 1 works with conventional shotguns and other projecting means.

Figure 6:
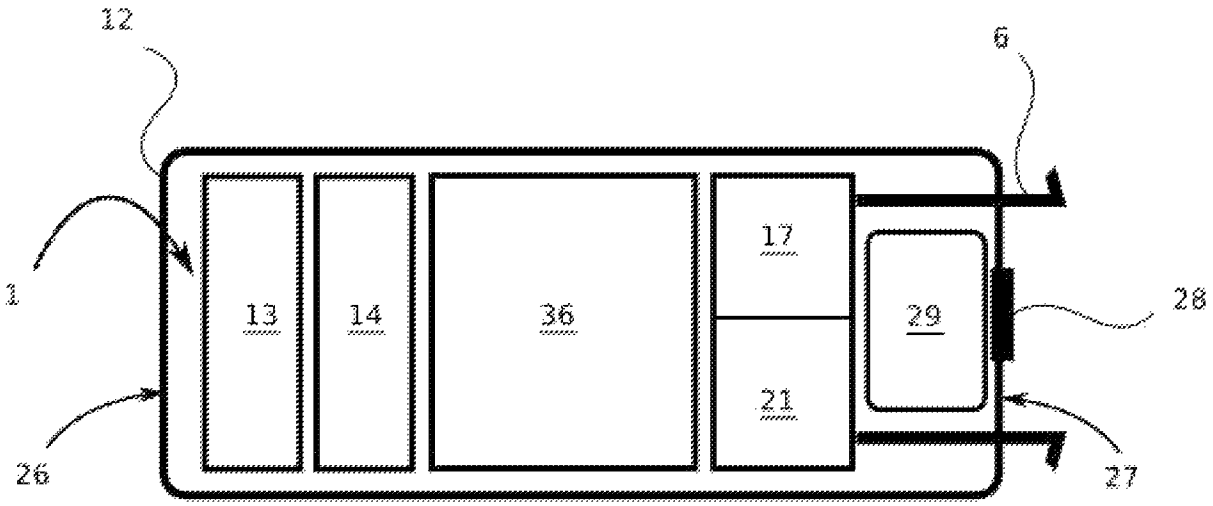
FIG. 6 illustrates a cross sectional side view of a third embodiment of a device first shown in FIG. 1 where the power source includes use of a battery or stored source of power.

FIG. 6 illustrates a cross sectional side view of a third embodiment of a device first shown in FIG. 1 where the power source includes use of a battery or stored source of power. With reference to FIG. 6, the device 1 includes a housing 12 having a proximal end 26 and a distal end 27. The housing 12 encloses other components of the device 1. The device 1 includes a sound generator 13 which in turn includes a speaker. The sound generator 13 is powered by a power source. The sound generator 13 is recordable for approximately 6-15 seconds. The sound may be an animal, human or siren-type noise. The message repeats as long as power is available. The sound generator 13 is electronically connected with circuitry 14 and components collectively referred to as element 36. Element 36 includes various components including a battery, control board with a micro sound chip, timer circuitry and an impact trigger or sensor. Leads and wires between various components of the device 1 are not shown in FIG. 6 for sake of simplicity of illustration. The circuitry 14 or one or more components of element 36 may include controlling elements that direct actuation of the other elements in the device 1 such as the sound generator 13 or electrodes 4 for delivering conditioning shocks. According to a variation, the circuitry 14 includes an element for recording and storing the sounds that are then passed to the sound generator 13, or the sound generator 13 may include such element. One or more power sources of element 36 may provide power to the high-voltage electric coils 17 and one or more high-voltage capacitors 21. The sound generator 13 is recordable for approximately 6-15 seconds and, when activated, repeats the message for as long as power is available.

Figure 7:
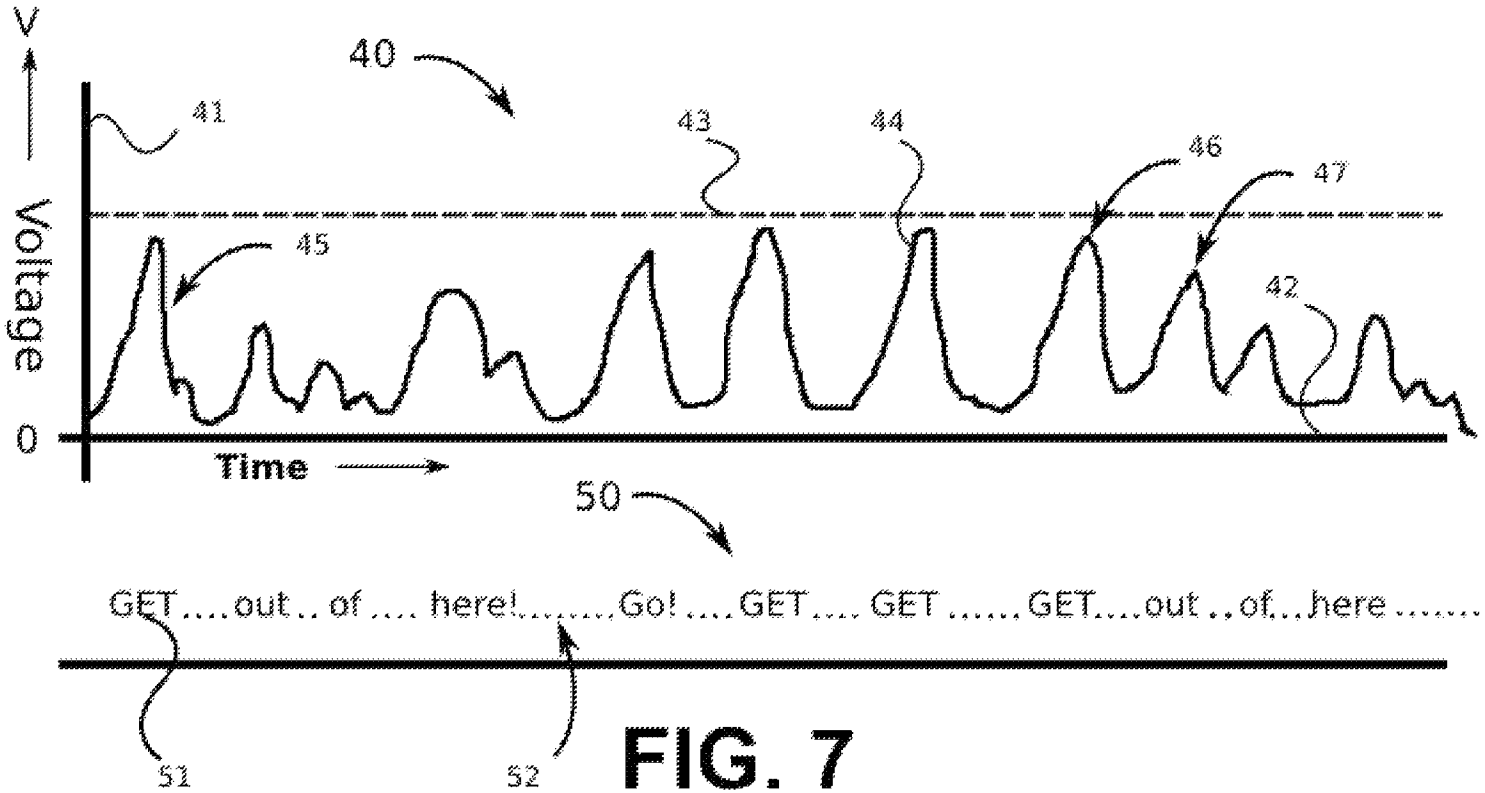
FIG. 7 is a graph showing electrical shock intensity in volts coordinated with a recording of a voice expression according to a first embodiment.

FIG. 7 is a graph showing electrical shock intensity in volts coordinated with a recording of a voice expression according to a first embodiment. As indicated above, the device as described herein can be loaded with a recording or can record a sound or series of sounds, or siren, animal sounds or human sounds (e.g., voice, yells, words, phrases, automobile sounds). The stored recording can be played through a sound generator. According to a preferred implementation, the recording is played back at the same time as, or in coordination with, administration of an electrical shock.

With reference to FIG. 7, the coordination is as follows. A device is programmed to release a variable amount of electric shock over time through the electrodes of the device to the target. The electric shock is in proportion to, or can be described as, a voltage 44 as indicated in the graph 40 as Voltage V. The voltage 44 varies from a baseline voltage 42 to a maximum voltage 43 as graphed along a vertical axis 41. The baseline voltage 42 may be any voltage from zero to 100 volts when no voice or sound is emitted by the device. The horizontal axis in the graph 40 is advancement of time going from left to right.

According to one implementation, the voltage 44 is modulated upward in coordination with release or generation of sound by the sound generator 13. The modulation may be up to a 100 volts, or may be modulated by high voltage components in the device to a much higher voltage. The voltage 44 varies directly proportionally to the intensity of the sound emitted from the sound generator. A recorded or generated sound sequence or a voiced set of expressions 50 is presented below the voltage graph 40. The sound sequence 50 includes human enunciated words 51 separated to pauses 52, preferably according to typical human expression as if a person were present near the target and uttering the sound sequence 50. As illustrated, this sound sequence or set of expressions is the phrase, "GET . . . out . . . of . . . here! Go! . . . GET . . . GET . . . GET . . . out . . . of . . . here."

According to one implementation, a component of the device 1 such as the sound generator 13 or circuitry 14 includes a memory loaded with amplitude data or an amplitude function correlated with a time or with content of the sound sequence 50. The amplitude data or amplitude function is used to generate a signal to the other components so as to deliver an attenuated or modulated voltage 44 to the target. According to another implementation, a volume of sound emitted from the sound generator 13 or signal generated thereby is used modulate the voltage 44.

Referring to FIG. 7, a voltage spike 45 or intense shock is administered in coordination with generation of each word such as the word "GET" 51. The word GET 51 is upper-case indicating that the recording of this word is effectively shouted from the device as if a human were present and sternly expressing or emphasizing this word. The target is conditioned by feeling the shock or voltage spike 45 at the same time as hearing the word GET 51. Similar voltage spikes 46, 47 are released in coordination with release of words with subsequently emitted "GET" and "out" and other words as shown by the voltage 44 over time. The set of expressions 50 shown is approximately six seconds in duration. The shock (voltage 44 and voltage spikes 45) is administered and expressions 50 are emitted from the device as long as the device has power through the power sources indicated and suggested herein. In a preferred implementation, the device is powered for at least several cycles of the recorded expressions 50.

While human expression 50, including words 51, is illustrated, the sound or set of sounds emitted and repeated by the sound generator 50 may be any sound including such things as a car horn, a police siren, and an all-clear signal at a work site. The sound recorded and used in the device is preferably selected consistent with what is most appropriate for the type of target. For example, when a campground has trouble with bears, and humans are likely to use car horns to scare off or warn the bears, the device may be loaded with car horn sounds and administered to bears in the area. In this way, use of the device can be very narrowly tailored to each specific situation to maximize the impact of conditioning of targets for the benefit of all involved.

Figure 8A:
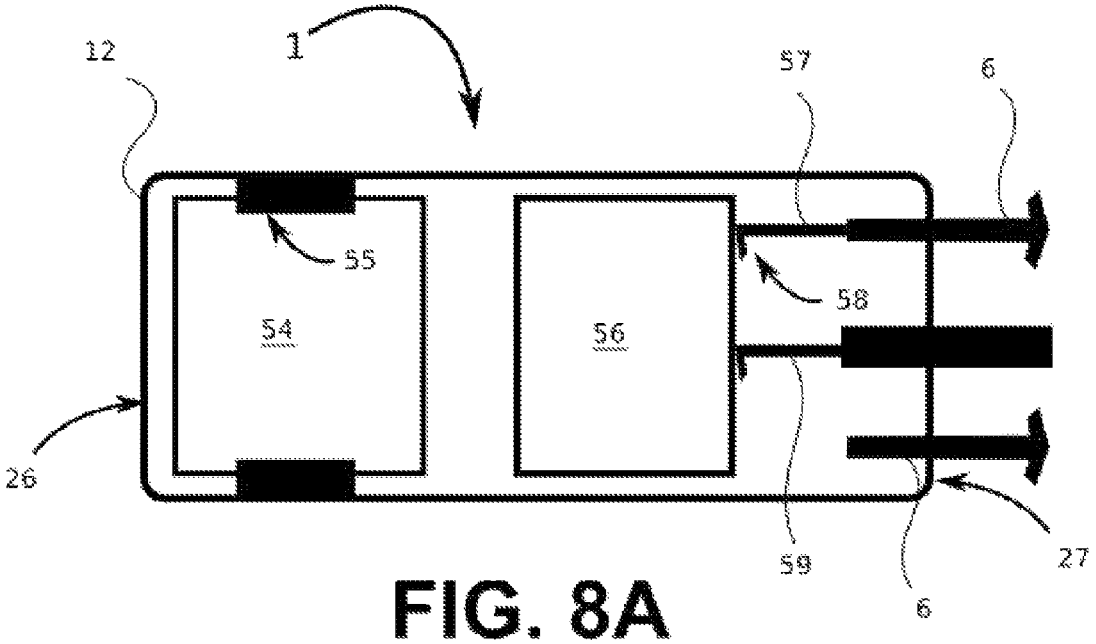
FIGS. 8A and 8B are each a cross sectional side view of fourth embodiment of a device first shown in FIG. 1 where the power source includes a container that opens upon impact with a target thereby providing increased shelf life of the device.
Figure 8B:
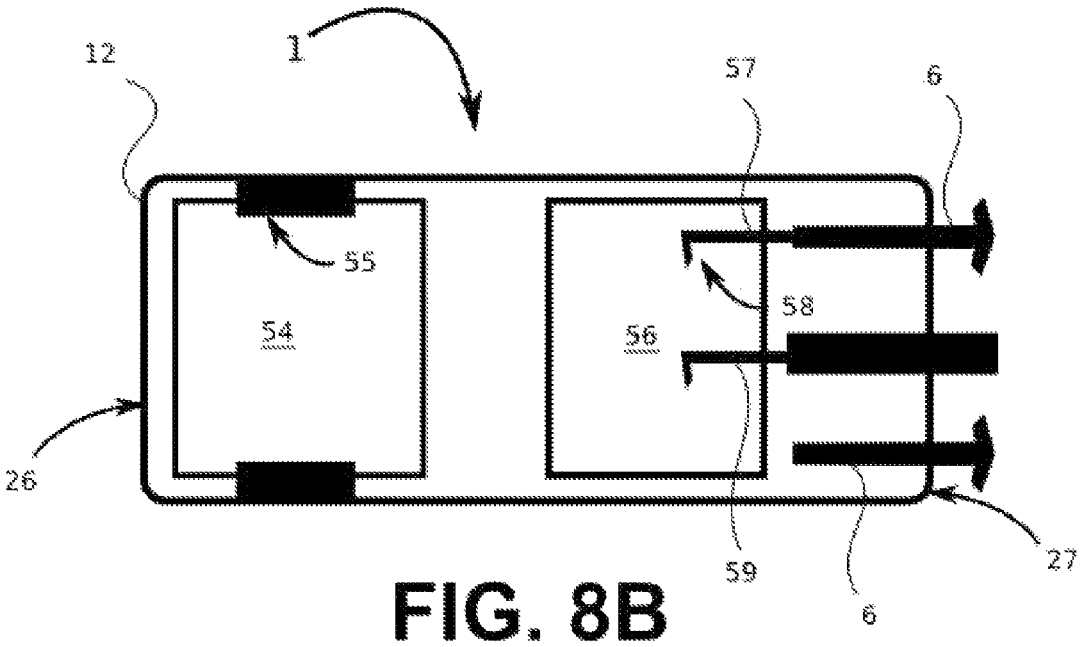

FIGS. 8A and 8B are each a cross sectional side view of fourth embodiment of a device first shown in FIG. 1. FIG. 8A is an illustration of the device 1 before it impacts a target (not shown). With reference to FIG. 8A, the device 1 includes various electronics 54 as described in reference to other figures such as a sound generator and a shock generator. Electronic leads are not shown for sake of simplicity of illustration. The electronics 54 are firmly affixed to the housing 12 by one or more fasteners 55, the electronics 54 preferably lying near the proximal end 26 of the housing 12. Toward the distal end 27 of the device 1, the power source includes various elements 56-57, and 59. The power source is activated when the device 1 impacts the target. With such an arrangement, the power source (and thereby the device 1) has a substantially longer shelf life when compared to a standard alkaline battery such as a cylindrical carbon zinc alkaline battery.

The power source includes a container or bladder of electrolyte 56. The electrolyte 56 can be sulfuric acid such as a dilute or a concentrated solution of the same. The size and concentration of the bladder 56 may be varied depending on desired use and application of the device 1. On impact, one or both power terminals 57, 59 are combined with the electrolyte 56, and thereby form a complete battery or energy source. In the implementation shown, one of the electrodes 6 impacts the target and pushes one power terminal 57 into the electrolyte 56. Additionally, for sake of illustration, a separate mechanical mechanism, the rectangular block shown proximate to the second power terminal 59 located between the two electrodes 6, is slid toward the left upon impact which causes the second power terminal 59 to enter into the bladder 56. A barb 58 on each proximal end of the power terminals 57, 59 cause the power terminals 57, 59 to enter the bladder 56 and to remain therein for the life of the device 1.

FIG. 8B shows the device 1 after impact with the target (not shown). The two power terminals 57, 59 have been inserted into the bladder 56. While a single cell is shown for the power supply, it is possible to use the described technique of combining or daisy-chaining together several cells of power such as several cells of lead-acid batteries. For example, cells can be composed of a lead-dioxide cathode 57, a sponge metallic lead anode 59 and a sulphuric acid solution electrolyte in the bladder 56. Thus, the device 1 can sit for a relatively long time on a shelf or other storage location without losing its efficacy when used. This technique for providing power is especially useful where the location of actual use is far from typical supply routes and supply stores and where humans are likely to encounter animals.

Figure 9:
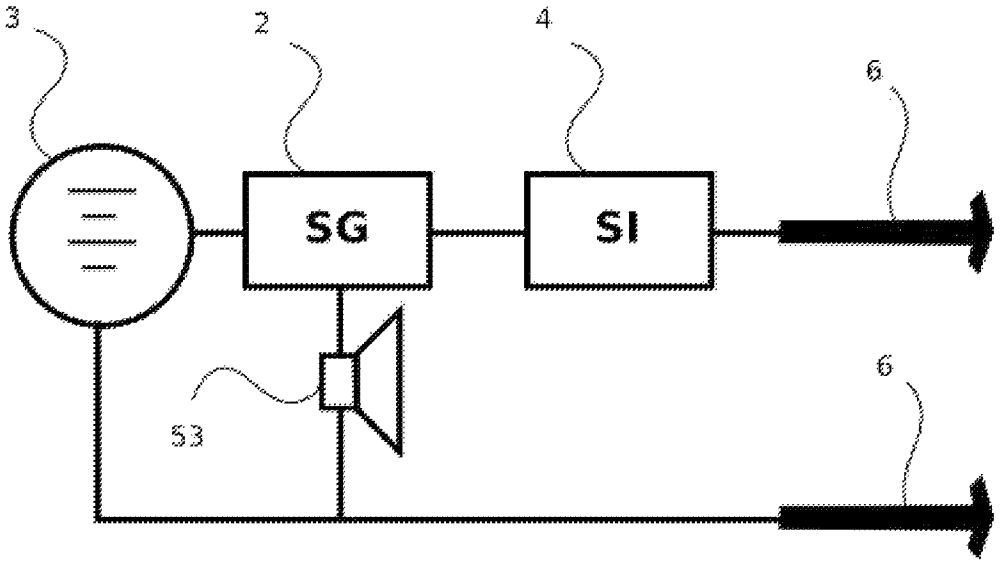
FIG. 9 is an electronic schematic diagram that illustrates components of a device described herein.

FIG. 9 is an electronic schematic diagram that illustrates components of the device described herein. With reference to FIG. 9, a device includes a power supply 3 in electronic communication with a sound generator (SG) 2. The sound generator 2 provides a signal to a speaker 53. The sound generator 2 also generates a signal to a shock inducer 4. The shock inducer (SI) 4 can include a coil, wire windings or a transformer. The shock inducer 4 may be referred to as a shock coil. The shock inducer 4 is electrically connected with one or more electrodes 6; two electrodes 6 are shown. Since the sound generator 2 is driving both the speaker 53 and the shock inducer 4, the target (not shown) is conditioned by receiving shocks in coordination with hearing sounds from the speaker 53. For example, a varying voltage supplied to the speaker 53 can be coordinated in a proportional way with a varying voltage supplied to the shock inducer 4.

Figure 10:
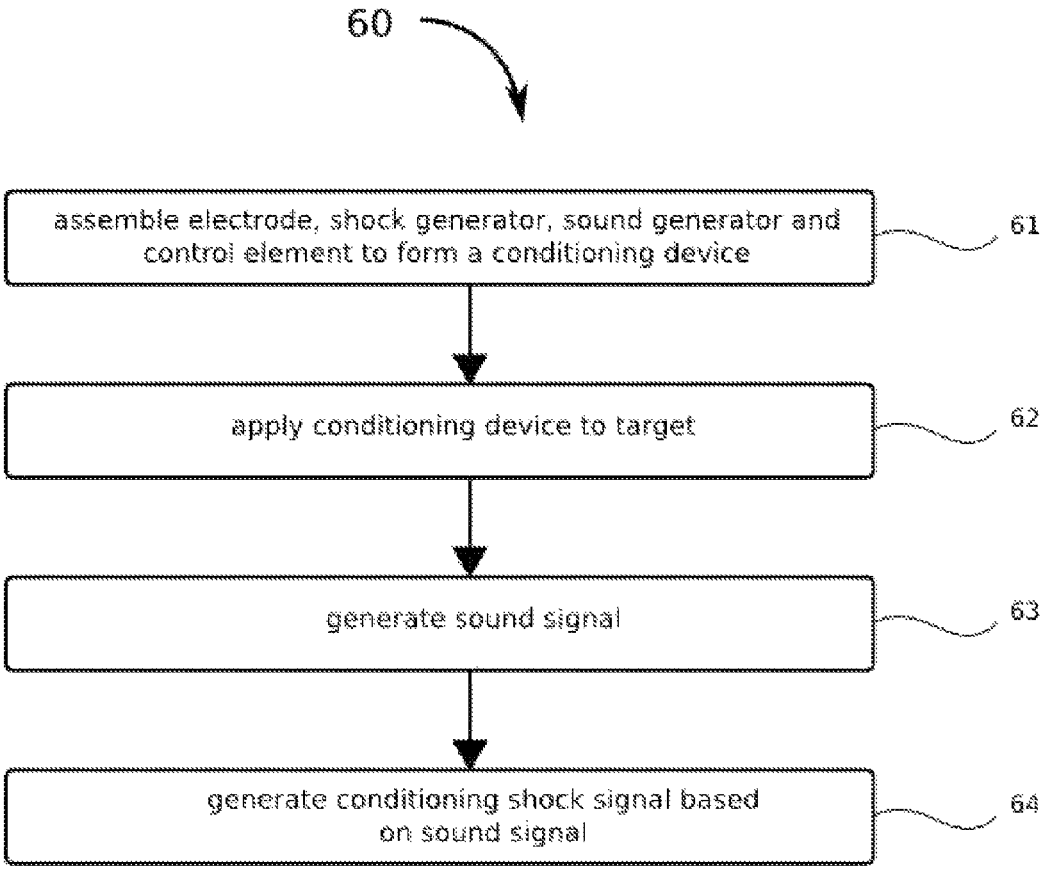
FIG. 10 is a flowchart illustrating a method or procedure for using the devices described herein.

FIG. 10 is a flowchart illustrating a method or procedure 60 for using the devices described herein. One step 61 includes assembling at least one electrode, a shock generator, a sound generator and a power supply. A control element can be inherent or included in one of these components, or the control element can be a separate component or electric circuit. The elements may be affixed to or inside a housing. The components or assembled housing is inserted into a casing of a shotgun shell or the like. In the next step 62, a conditioning device is applied to a target. This step can involve firing the shotgun shell loaded with the conditioning device. In the next step 63, the conditioning device generates a sound signal. In the last shown step 64, a conditioning shock signal is generated based on the sound signal.

CONCLUSION

In the previous description, for purposes of explanation, numerous specific details are set forth in order to provide an understanding of the invention. It will be apparent, however, to one skilled in the art that the invention can be practiced without these specific details. In other instances, structures, devices, systems and methods are shown only in block diagram form in order to avoid obscuring the invention.

Reference in this specification to "one embodiment", "an embodiment", or "implementation" means that a particular feature, structure, or characteristic described in connection with the embodiment or implementation is included in at least one embodiment or implementation of the invention. Appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

It will be evident that the various modification and changes can be made to these embodiments without departing from the broader spirit of the description. In this technology, advancements are frequent and further advancements are not easily foreseen. The disclosed embodiments may be readily modifiable in arrangement and detail as facilitated by enabling technological advancements without departing from the principles of the present disclosure.

I claim:

1. An electronic conditioning device comprising:

sound sequence circuitry to generate a sound sequence, and wherein the sound sequence includes sounds, each sound having an intensity;

a sound generator in electronic communication with the sound sequence circuitry, the sound generator configured to emit the sound sequence audibly;

a power supply having exposed electrical leads and wherein the power supply is electrically coupled to the sound sequence circuitry and coupled to the sound generator;

a shock inducer having electrodes, and wherein the shock inducer is electrically coupled to the power supply, wherein the shock inducer is configured to generate voltage spikes in coordination with and approximately at a same time as at least of the sounds of the sound sequence, and wherein each voltage spike is proportional to each respective sound intensity; and an impact detector that triggers operation of the device when the device impacts a target, wherein the impact detector is configured to start electric current flowing from the power supply upon impact.

2. The device of claim 1, and wherein the sounds of the sound sequence are recorded audible tones.

3. The device of claim 1, and wherein the sounds of the sound sequence are a recorded sequence of human expressions, and wherein an amplitude of each voltage spike is coordinated with each respective human expression.

4. The device of claim 1, and wherein the shock inducer includes a high-voltage capacitor in electronic communication with one or more other components and configured to modulate the voltage spikes to a relatively high voltage depending on the intensity of the respective sounds.

5. The device of claim 1, and wherein the power supply includes a magnet affixed to a movable portion of a reed proximate to a coil of metal, and wherein the reed is mechanically configured to vibrate in response to motion of the device thereby converting kinetic energy into electric energy for the device.

6. The device of claim 1, and wherein the power supply includes a piezoelectric film, and wherein the piezoelectric film is mechanically configured to flex in response to motion of the device thereby converting kinetic energy into electric energy for the device.

7. The device of claim 1, and wherein the power supply includes a form of stored chemical energy convertible into electric energy for the device.

8. The device of claim 1, and wherein the device further comprises:

a nozzle at a leading end of the device;

a dye repository proximate to the nozzle so that the dye is deployed onto a target through the nozzle when the device impacts the target.

9. The device of claim 8, and wherein the nozzle includes outer shaped contours so as to allow the dye to create a silhouette of substantially similar shape as that of the shaped contours of the nozzle when the dye is deployed.

10. The device of claim 1, and wherein the electronic conditioning device further includes an ammunition cartridge having a propellant for projecting the device when the ammunition cartridge is fired; wherein the sound sequence circuitry, the sound generator, the power supply, and the shock inducer are installed within a housing inside of the ammunition cartridge; and wherein the electrodes protrude through to the outside of the housing.

11. An electric discharge device comprising:

a housing forming an aperture on a proximal end of the same;

a control circuit;

a shock generator;

a sound generator;

an electric power supply within the housing and electrically coupled to the control circuit, the shock generator, and the sound generator; wherein the shock generator includes at least one electrode; and a gun shell inside of which is loaded the housing, the control circuit, the shock generator, the sound generator, and the electric power supply, wherein the gun shell includes a propellant for projecting the housing at a target, wherein the control circuit is configured to operate the sound generator in coordination with the shock generator, and wherein the shock generator is configured to contemporaneously administer voltage spikes to the target substantially in proportion to an attribute of the respective sounds from the sound generator.

12. The electric discharge device of claim 11, wherein at least a portion of an outer surface of the housing is contoured to promote spiraling when the housing is projected from the gun shell.

13. The electric discharge device of claim 11; wherein the power supply includes a flexible element configured to bend and thereby convert kinetic energy into electric energy for use by the shock generator, the control circuit and the sound generator; and wherein the flexible element includes a piezoelectric film or a flexible reed to which is attached a magnet or coil of wire.

14. The electric discharge device of claim 11, wherein the sound generator includes a piezoelectric speaker, and wherein the sounds generated reach at least approximately 80 dB in amplitude.

15. The electric discharge device of claim 11, wherein an outer diameter of the housing is less than approximately 0.75 inches, and wherein the voltage spikes are modulated over a voltage of approximately 1,000 volts.

16. The electric discharge device of claim 11, and wherein the device further comprises:

a dye packet having a quantity of dye inside thereof, wherein the dye packet is placed inside the housing proximate to a distal (impact) end of the housing, and wherein the distal end of the housing is formed into a nozzle through which is applied dye from the dye packet upon the housing impacting the target.

17. A method for conditioning a target with electric shock coordinated with audible signals, the method comprising:

assembling to a housing to form a conditioning device, an electrode, a shock generator, a sound generator configured to generate audible signals, and a control circuit;

applying the conditioning device to the target by inserting the electrode into the skin of the target; and activating the conditioning device by activating the control circuit to operate the shock generator substantially contemporaneously with the sound generator, and wherein the control circuit causes generation of voltage spikes substantially in proportion to an attribute of at least some of the audible signals.

18. The method of claim 17, and wherein the voltage spikes are modulated upward to an increased voltage substantially in proportion to an intensity of the respective audible signal.

19. The method of claim 17, and wherein the conditioning device is applied by firing the conditioning device from a ballistic shell propelled by gunpowder.

* * * * *